US005411775A

United States Patent [19]

Wilson

[11] Patent Number: 5,411,775

[45] Date of Patent: May 2, 1995

[54] ARTIFICIAL CATTAILS AND METHOD FOR MAKING ARTIFICIAL CATTAILS

[76] Inventor: Warren F. Wilson, 212 Birch St., Rte. 1, Storm Lake, Iowa 50588

[21] Appl. No.: 233,306

[22] Filed: Apr. 26, 1994

[51] Int. Cl.[6] ..... A41G 1/00

[52] U.S. Cl. ..... 428/17; 156/61; 428/26

[58] Field of Search ..... 428/17, 26, 919; 156/61

[56] References Cited

U.S. PATENT DOCUMENTS 2,744,348 5/1956 Smith ..... 428/919 X
3,876,495 4/1975 Esler ..... 428/400 X
4,789,572 12/1988 Weaver ..... 428/26
5,066,529 11/1991 Huber ..... 428/40

*Primary Examiner*—Henry F. Epstein
*Attorney, Agent, or Firm*—Zarley, McKee, Thomte, Voorhees, & Sease

[57] ABSTRACT

The artificial cattail of the present invention includes a stem made from a wooden dowel, and a blossom made from a tubular polyethylene form cord coated with flocking. Synthetic or real leaves are attached to the stem. The artificial cattails can be any color. In making the artificial cattails, the stem is inserted through the tubular cord, which is then coated with adhesive and sprayed with the flocking material.

20 Claims, 2 Drawing Sheets 18
14
12
16
16
10

20
L 22
20
24
30
34
18
12
28
32
34
26
28
32

5
26
28
34
12
32
28
34
5

ARTIFICIAL CATTAILS AND METHOD FOR MAKING ARTIFICIAL CATTAILS

BACKGROUND OF THE INVENTION

Cattails are popular for use in flower arrangements, taxidermy exhibits, and other decorative or ornamental displays. However, the blossoms of real cattails decay or deteriorate over time. Also, it is difficult to dust real cattail blossoms. Therefore, the use of real cattails is limited.

There have been attempts to make artificial cattails which simulate real cattails, but the artificial products have not been good replicas of authentic cattails. For example, one artificial cattail known to the applicant is made from a pipe-cleaner type material. In this pipe-cleaner artificial cattail, the blossom is formed with soft fleece-like material wrapped on a wire, and the wire is wrapped at the opposite ends of the fleece material to simulate the cattail stem. This artificial cattail does not have a realistic appearance, and is easily deformed into unusual and odd shapes. Therefore, such a pipe-cleaner type artificial cattail is not desirable for people wanting an artificial, yet realistic, product.

Therefore, a primary objective of the present invention is the provision of an artificial cattail which is realistic and natural in appearance.

Another objective of the present invention is the provision of a method for making a realistic appearing artificial cattail.

A further objective of the present invention is the provision of an artificial cattail which is easy and economical to manufacture, and durable in use.

Still another objective of the present invention is the provision of an artificial cattail which can be manufactured in miscellaneous colors.

These and other objectives will become apparent from the following description of the invention.

SUMMARY OF THE INVENTION

The artificial cattail of the present invention includes an elongated stem which is inserted into a tubular member. The tubular member is coated with a flocking material to simulate the blossom of a real cattail. The stem of the cattail extends through the tubular member, and the upper end of the stem protrudes from the upper end of the tubular member which is tapered to resemble the tip of a real cattail. Preferably, the stem is made from a wooden dowel and the tubular member is made from a polyethylene foam cord. Artificial or real leaves are attached to the stem.

To manufacture the artificial cattail of the present invention, the tubular member is placed in a jig, which holds the member as the stem is inserted therein. The tubular member, with the stem inserted in place, is then coated with an adhesive, and flocking is sprayed onto the adhesive-coated tubular member. The flocking may be any desired color, and the stem can be painted to a color matching that of the flocking. The adhesive may also be colored to match the flocking color. The leaves are attached to the stem to provide a realistic artificial cattail.

DETAILED DESCRIPTION OF THE DRAWINGS

Figures 1, 2, 3, 4:
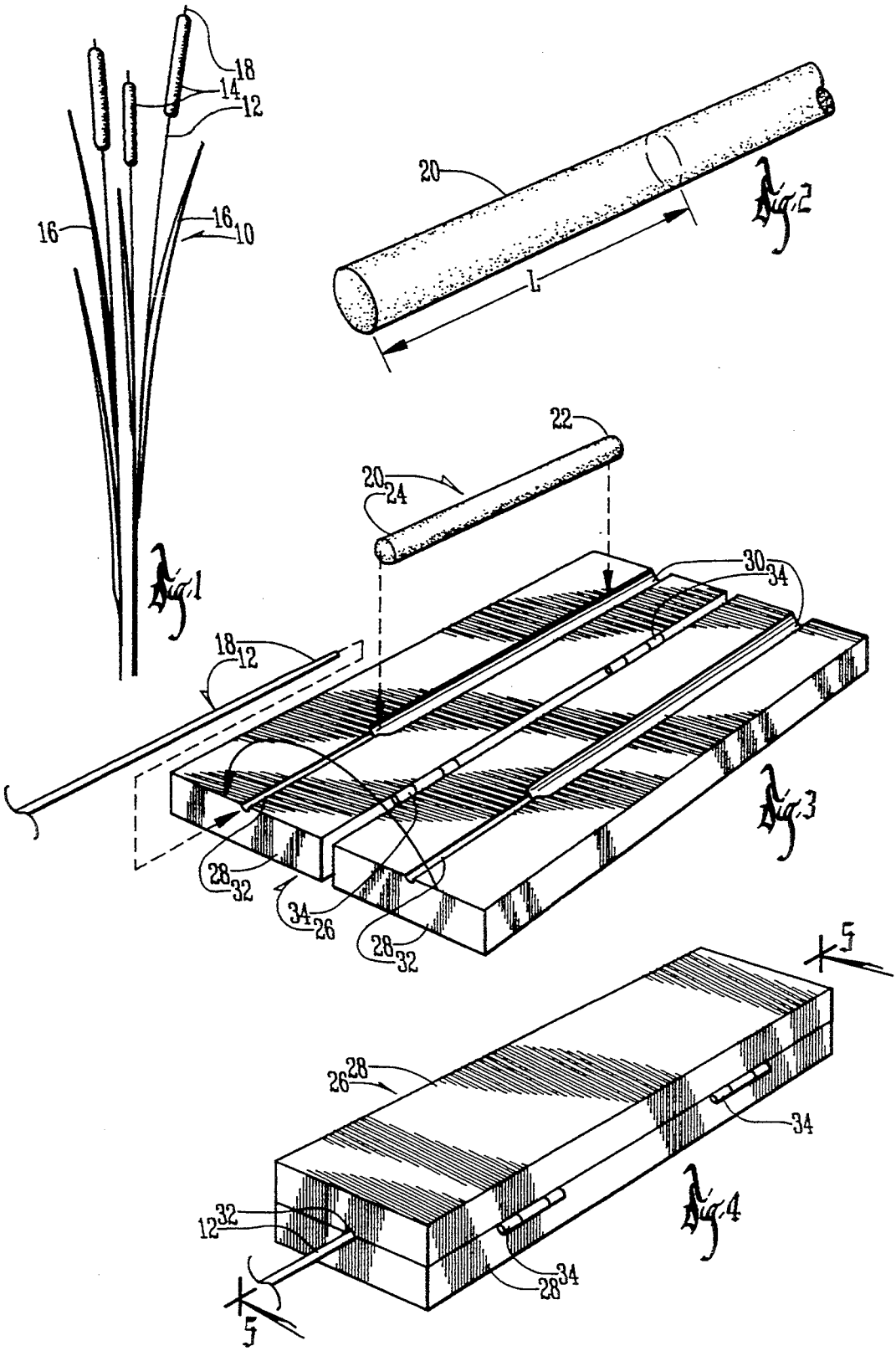
FIG. 1 is a perspective view showing the artificial cattails of the present invention.
FIG. 2 is a perspective view showing the tubular member which is a part of the cattail blossom.
FIG. 3 is an exploded perspective view of a stem and the tubular member, and a jig used to assemble the stem and tubular member.
FIG. 4 is a perspective view showing the jig in a closed position for assembling the stem and tubular member.

The artificial cattails of the present invention are generally designated in the drawings by the reference numeral 10. The cattails 10 include a stem 12, a blossom 14 near the top of the stem, and a plurality of leaves 16 extending from the stem. The stem 12 includes an upper end or tip 18 extending above the blossom 14.

The stem is preferably made from a hardwood dowel having a diameter from $\frac{1}{8}$ inch to $\frac{1}{4}$ inch. The dowel can be cut in any length, such as 18 inches, 24 inches, or 36 inches. The tip 18 of the stem is tapered to provide a realistic appearance. Alternatively, the stem 12 can be made from a wire or rod which may be wrapped or painted to provide a natural appearance. Also, the stem 12 can be made from a real cattail stem after the real blossom is removed.

The blossom 14 is a tubular member, preferably made from polyethylene foam cord. Other plastic or synthetic tubular materials may be used for the blossom 14. The tubular member 20 may have various diameters, depending upon the desired size of the cattail blossom, such as $\frac{3}{8}$ inch, $\frac{1}{2}$ inch, $\frac{3}{4}$ inch, and 1 inch. The tubular member 20 is also cut to any desired length, normally from 3 inches to 10 inches. The upper end 22 and lower end 24 of the tubular member 20 are rounded to give the member a natural blossom shape.

The leaves 16 may be made of a material such as silk, commonly used in artificial silk flowers. Alternatively, real cattail leaves can be dried and then used on the artificial cattail 10. The leaves 16 are attached to the stem 12 by any conventional means, such as adhesive or tape.

A multi-step process is used to make the cattails 10. The stem 12 is cut to a desired length, and the tip 18 is tapered for a length of approximately 1 inch at the upper end of the stem 12. The tubular member 20 is also cut to the desired length, and the upper and lower ends 22, 24, respectively are rounded by any convenient means, such as a grinder.

The stem 12 is pushed into the blossom 14 so as to extend therethrough, with the tip 18 protruding from the upper end 22 of the tubular member 20. To facilitate the insertion of the stem 12 into the tubular member 20, a jig 26 is provided. The jig includes two blocks 28 each having a large diameter groove 30 and a small diameter groove 32. The diameter of the larger groove 30 corresponds to the diameter of the tubular member 20, and the smaller groove 32 is slightly larger than the diameter of the stem 12. The jig blocks 28 are hinged together by hinges 34.

Figure 5:
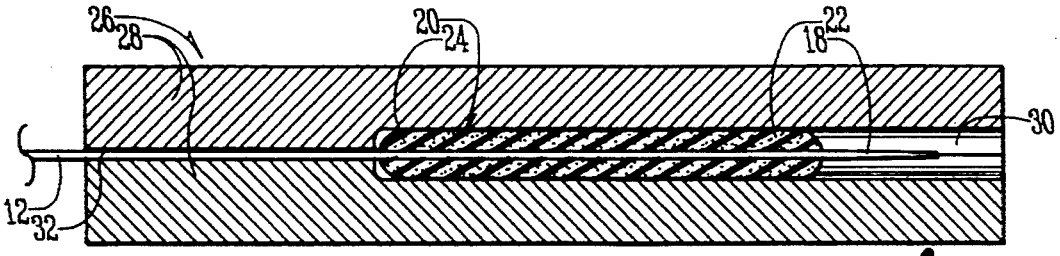
FIG. 5 is a sectional view taken along lines 5—5 of FIG. 4.

To insert the stem 12 into the tubular member 20, the tubular member is laid into the groove 30 of one of the blocks 28. The jig 26 is then closed by pivoting the other block 28 about the hinge axis, thereby holding the tubular member 20 securely within the grooves 30 of the blocks 28. The stem 12 is then slid into the hole in the end of the jig defined by the small grooves 32 and pushed through the tubular member 20 while the jig remains closed. After the stem has been forced through the tubular member 20 such that the tip 18 of the stem extends the desired distance above the upper end 22 of the tubular member, the jig 26 is opened, and the assembled stem and tubular member are removed. As seen in FIG. 5, the jig 26 assures that the stem 20 is centered with respect to the tubular member and goes substantially straight through the longitudinal axis of the tubular member.

As an alternative to the stem extending through the entire length of the tubular member, as shown in FIG. 5, a lower stem section may be inserted into the lower end of the tubular member and a separate upper stem section may be inserted into the upper end of the tubular member.

Figure 6:
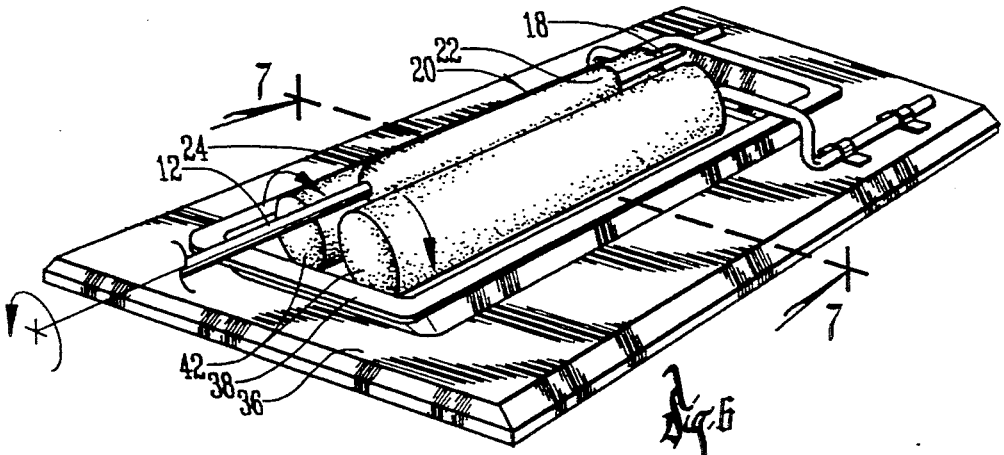
FIG. 6 is a perspective view showing the adhesive bath assembly for applying adhesive to the tubular member.
Figure 7:
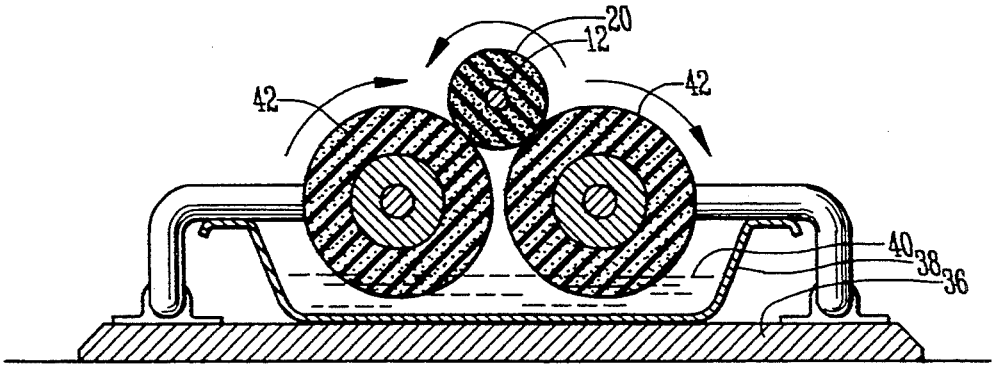
FIG. 7 is a sectional view taken along lines 7—7 of FIG. 6.
Figure 8:
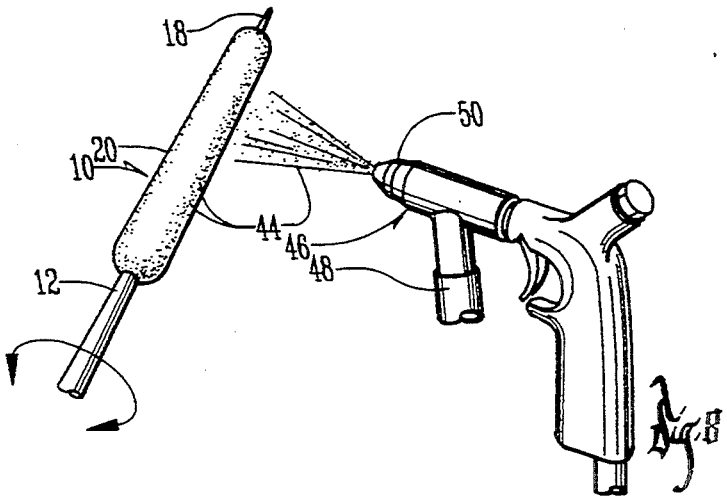
FIG. 8 is a perspective view showing the spray application of flocking to the tubular member.

The tubular member 20 is then coated with an adhesive. The adhesive or glue may be applied from a bath, as shown in FIGS. 6 and 7. More particularly, a frame 36 supports a tray 38 which holds a quantity of liquid adhesive 40. A pair of rollers 42 are mounted upon the frame 36 for rotation about their parallel axes. The surfaces of the rollers 42 extend into the adhesive bath 40. When the tubular member 20 is laid upon the rollers 42, as seen in FIGS. 6 and 7, the stem 12 can be turned, thereby rotating the tubular member 20 about the axis defined by the stem 12, which in turn rotates the rollers 42, as indicated by the arrows in FIG. 7, thereby applying adhesive to the surface of the tubular member 20. Alternatively, the tubular member may be sprayed with adhesive or dipped in adhesive, though it is desirable to minimize the application of the adhesive to the stem 12.

Before the adhesive dries, the flocking 44 is sprayed onto the tubular member 20. A compressed air spray gun 46 has a supply line 48 which extends it into a source of flocking material. Upon actuation of the spray gun 46, the flocking is drawn through the supply line 48 and ejected from the nozzle 50 so as to form a fine layer of flocking on the adhesive-coated tubular member 20. Preferably, the flocking is a finely ground rayon, which is commercially available. The flocking provides the tubular member with the natural appearance and texture of a real cattail blossom.

In order to achieve a natural looking artificial cattail, the flocking 44 is a dark brown color. However, the flocking may be any desired color so as to match interior decorating schemes. Preferably, the adhesive is colored to match the flocking color. Also, the stem 12 may be colored any desired color.

From the foregoing, it can be seen that the artificial cattail of the present invention has a realistic and natural appearance. The polyethylene cord provides a realistic blossom shape, and the flocking 44 provides a realistic texture. If natural colors are used for the flocking, stem and leaves, the artificial cattail 10 of the present invention will closely simulate a real cattail in appearance. The cattails 10 may be otherwise colored to coordinate with decorating schemes.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An artificial cattail, comprising:

a stem;

an elongated tubular member mounted on the stem; and flocking adhered to the tubular member.

2. The artificial cattail of claim 1 further comprising an adhesive applied to the tubular member for adhering the flocking to the tubular member.

3. The artificial cattail of claim 1 wherein the tubular member has opposite upper and lower ends, and the artificial cattail further including a stem tip extending from the upper end of the tubular member.

4. The artificial cattail of claim 3 wherein the stem extends through the tubular member, and the stem tip is an end of the stem.

5. The artificial cattail of claim 1 wherein the stem is a wooden dowel.

6. The artificial cattail of claim 1 wherein the tubular member is a plastic cord.

7. The artificial cattail of claim 1 wherein the tubular member is a polyethylene foam cord.

8. The artificial cattail of claim 1 wherein the tubular member has rounded upper and lower ends.

9. The artificial cattail of claim 8 wherein the stem extends through the tubular member and has an upper tip protruding from the upper end of the tubular member.

10. The artificial cattail of claim 9 wherein the tip of the stem has a tapered end.

11. The artificial cattail of claim 1 further comprising leaves attached to the stem.

12. A method of making an artificial cattail, comprising:

cutting a tubular member to a desired length;

inserting a stem into the tubular member; and applying flocking to the tubular member.

13. The method of claim 12 further comprising applying an adhesive to the tubular member to adhere the flocking to the tubular member.

14. The method of claim 13 wherein the flocking is sprayed onto the tubular member.

15. The method of claim 12 further comprising coloring the stem to a desired color.

16. The method of claim 12 wherein the tubular member has opposite ends, and further comprising rounding the opposite ends of the tubular member.

17. The method of claim 12 wherein the stem extends through the tubular member and has an upper end protruding from the tubular member, the method further comprising tapering the end of the stem.

18. The method of claim 12 further comprising holding the tubular member in a jig while the stem is inserted into the tubular member.

19. The method of claim 12 further comprising coating the tubular member with adhesive before the flocking is applied.

20. The method of claim 12 further comprising attaching leaves to the stem.

* * * * *